US006070347A

United States Patent [19]

Hergott

[11] Patent Number: 6,070,347

[45] Date of Patent: Jun. 6, 2000

[54] FRAME MOUNTABLE IDENTIFYING DEVICE

[75] Inventor: Arthur Hergott, Deerfield, Ill.

[73] Assignee: Greenwich Industries, L.P., Lake Bluff, Ill.

[21] Appl. No.: 08/512,549

[22] Filed: Aug. 8, 1995

[51] Int. Cl.[7] ..... G09F 3/00

[52] U.S. Cl. ..... 40/320; 40/606; 40/607; 403/393

[58] Field of Search ..... 40/320, 606, 607, 40/611, 618, 617, 626; 403/393; 248/224.2, 225.11

[56] References Cited

U.S. PATENT DOCUMENTS

| | | | |
|---|---|---|---|
| 908,751 | 1/1909 | Cooke | 248/224.8 |
| 1,267,197 | 5/1918 | Euler | 248/224.8 |
| 2,200,158 | 5/1940 | Clarke | 248/224.8 |
| 2,271,928 | 2/1942 | Sims | 248/224.8 |
| 3,283,433 | 11/1966 | Navarino | 40/320 |
| 4,777,750 | 10/1988 | Garfinkle | 40/607 |

*Primary Examiner*—Cassandra Davis
*Attorney, Agent, or Firm*—Fitch, Even, Tabin & Flannery

[57] ABSTRACT

There is provided a frame mountable identifying device for displaying identifying indicia from a chair having a bracket with a mounting slot. The device includes a mounting bracket with a pin being releasably engaged with the mounting slot for mounting it to the chair. A spacer defines a gap between the mounting bracket and a platform. The platform may display identifying indica. The mounting bracket may include a threaded aperture which cooperates with a threaded fastener so it is movable between a mounting position for allowing the pin to be engaged in the mounting slot and a securing position for engaging the bracket of the chair to prevent release. The threaded fastener includes a leading end having a tool engaging configuration and has a length sufficient to maintain the leading end disposed in the gap upon movement between the mounting position and the securing position. The spacer may include a holder located in the gap for receiving an elongated support which includes an upper end and a lower end for being supported adjacent the chair. An elevated platform may be mounted to the upper end for displaying identifying indicia. The mounting bracket and holder may be disposed at a predetermined angle relative to one another for extending the elongated support in a predetermined direction relative to the bracket of the chair. The platform and holder may include openings communicating with the gap to provide access to the tool engaging configuration of the threaded fastener.

22 Claims, 6 Drawing Sheets

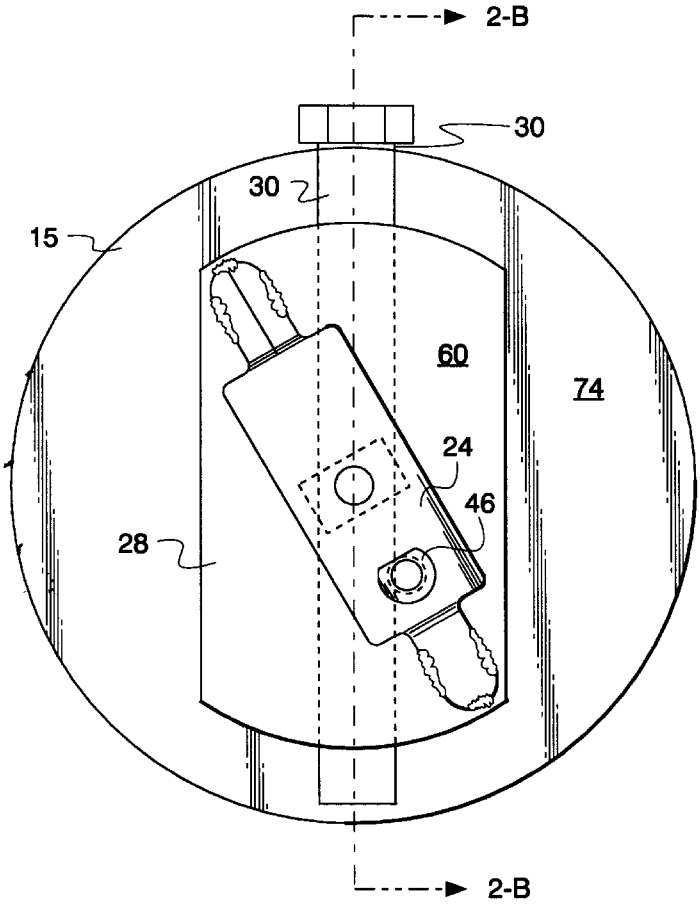
Fig. 2-A
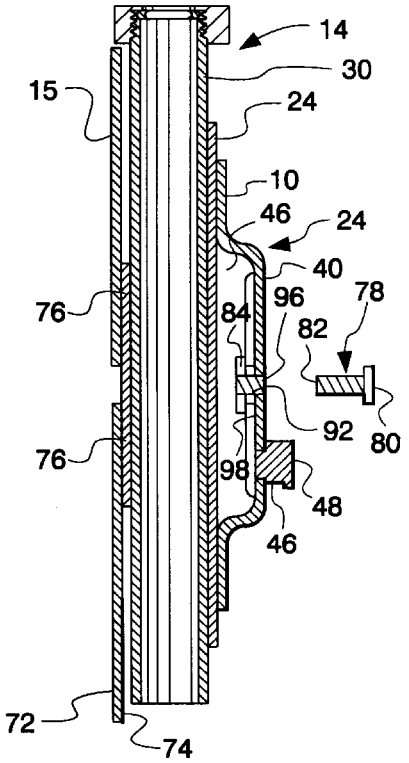
Fig. 2-B
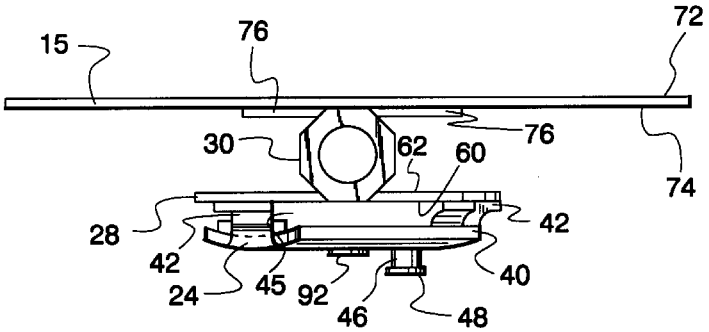
Fig. 2-C

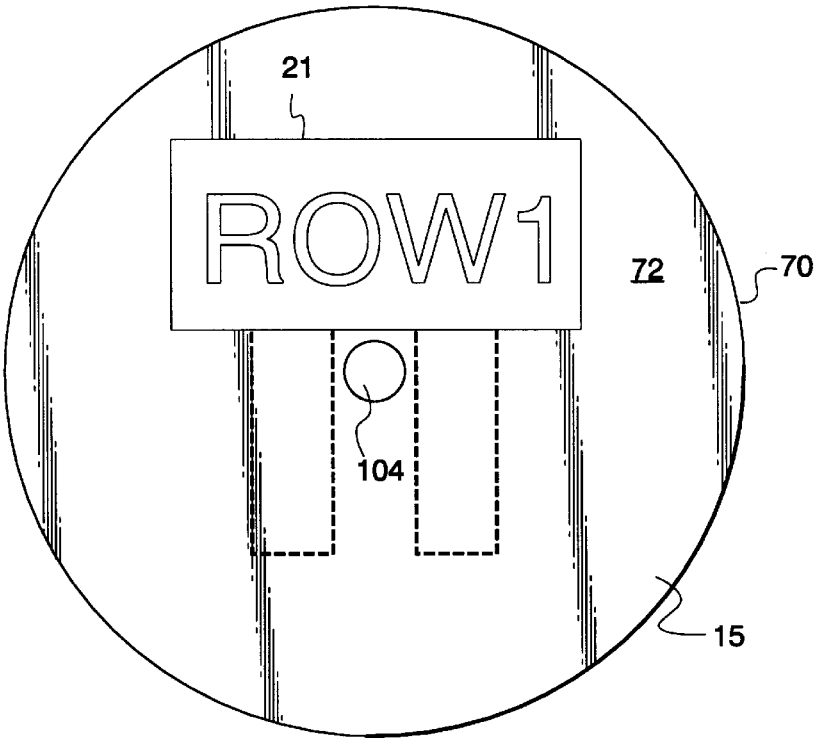
Fig. 3-A
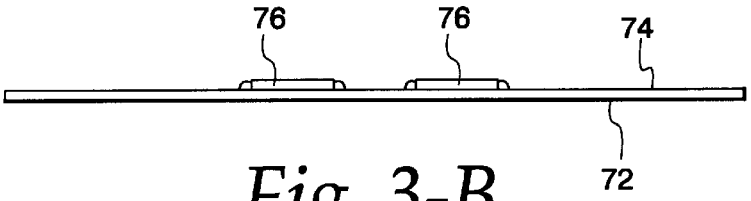
Fig. 3-B
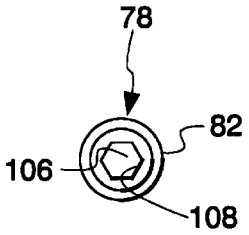
Fig. 4
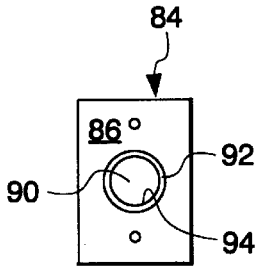
Fig. 5-A
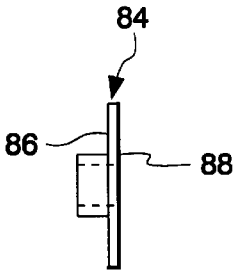
Fig. 5-B

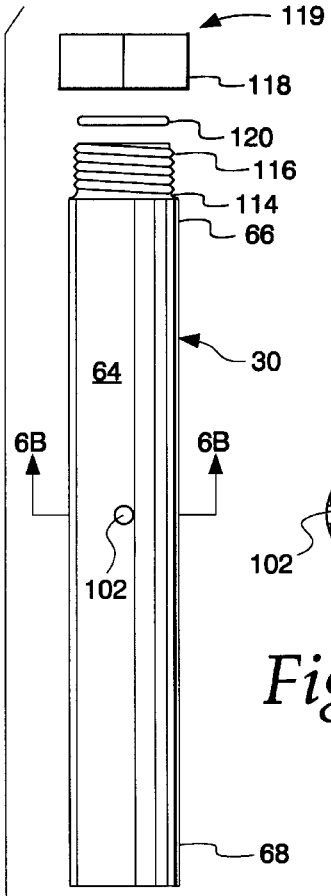
Fig. 6-A
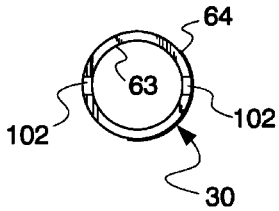
Fig. 6-B
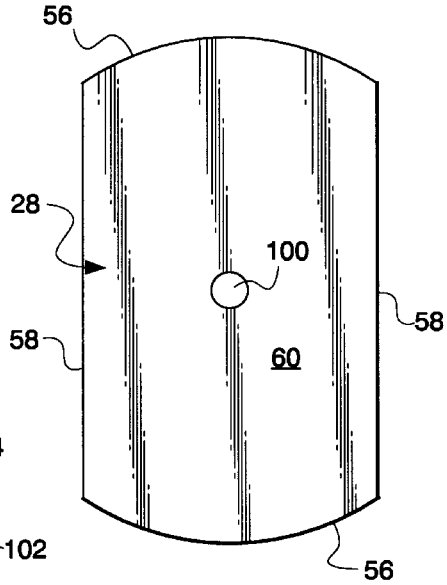
Fig. 7-A
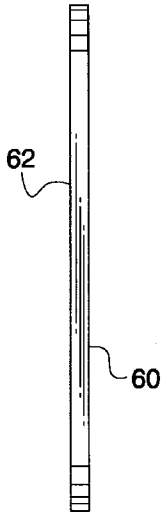
Fig. 7-B
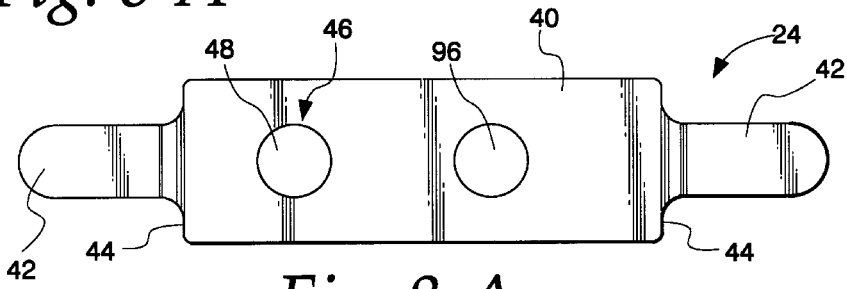
Fig. 8-A
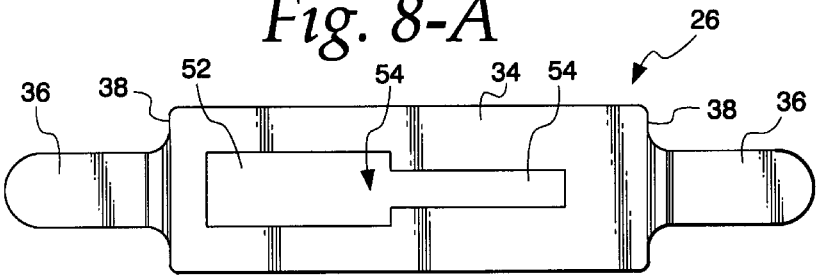
Fig. 8-B

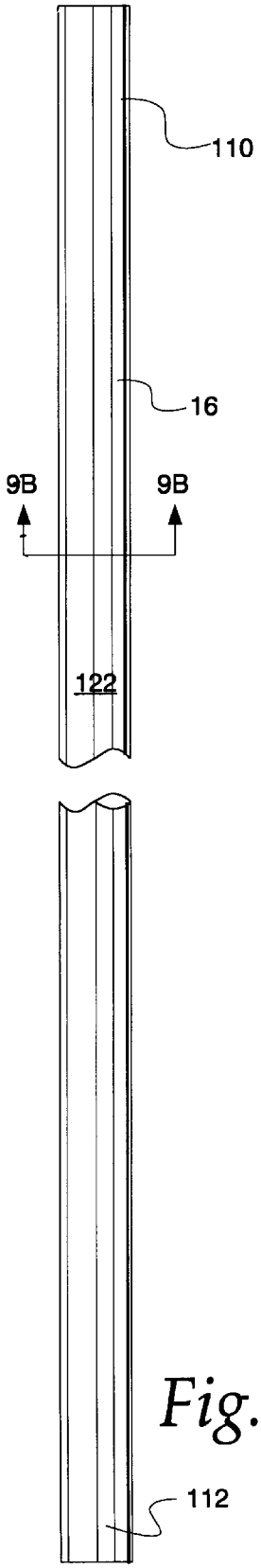
Fig. 9-A
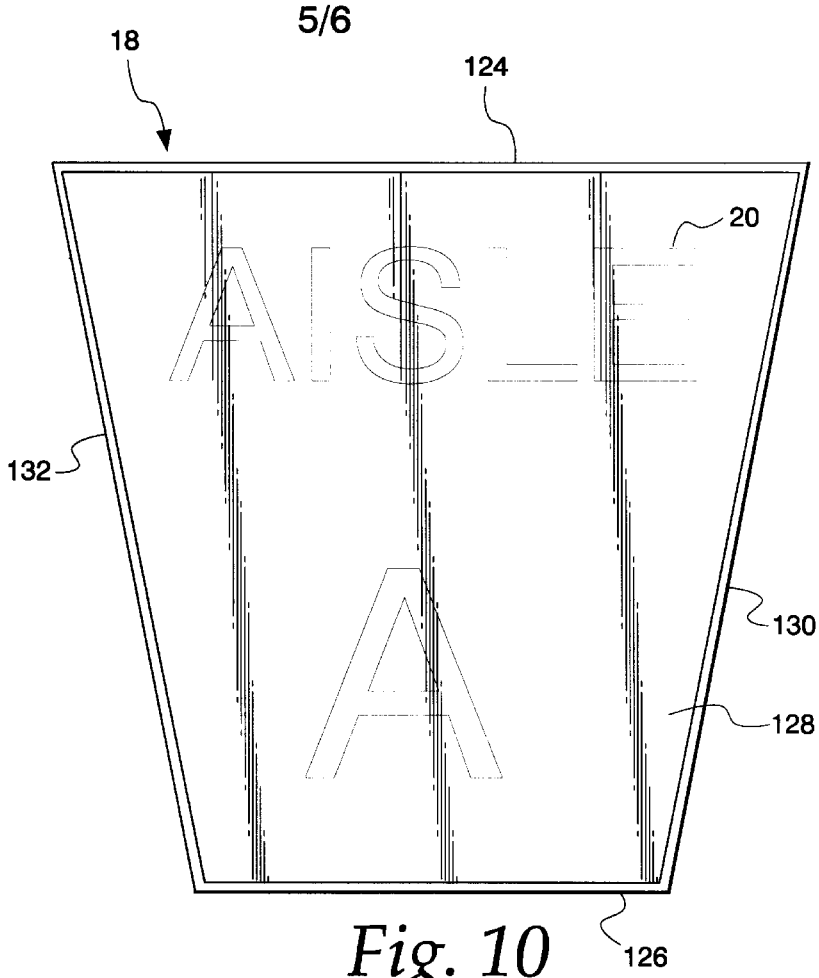
Fig. 10
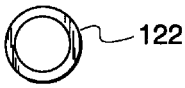
Fig. 9-B

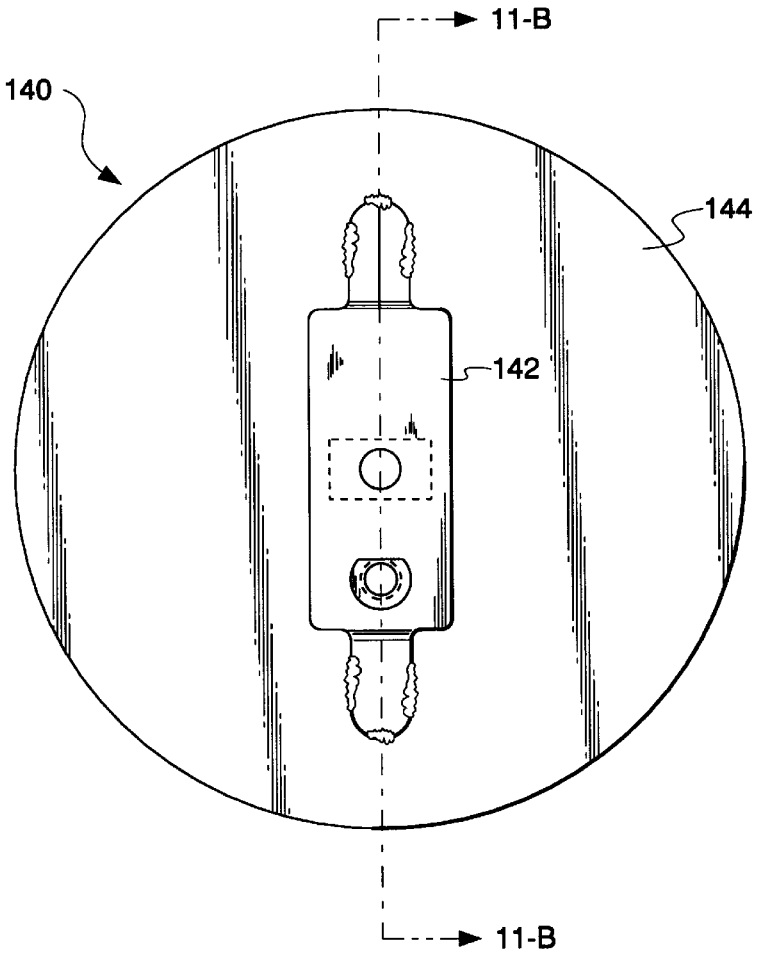
Fig. 11A
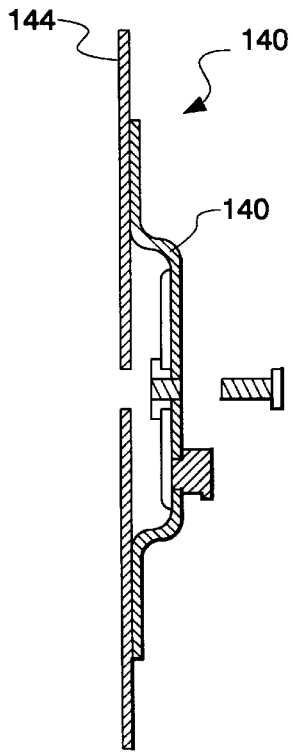
Fig. 11-B
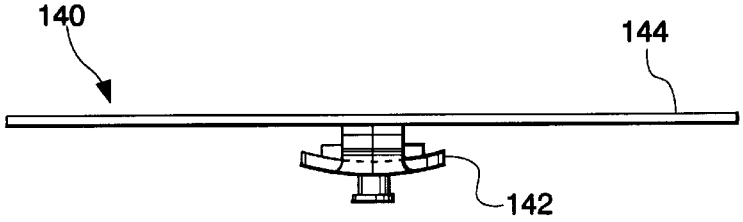
Fig. 11-C

FRAME MOUNTABLE IDENTIFYING DEVICE

FIELD OF THE INVENTION

The present invention relates generally to devices for marking or visually identifying objects and/or locations and, more particularly, to a frame mountable device that attaches to a frame for visually displaying indica for identifying the frame's location and that readily detaches from the chair frame for storage.

BACKGROUND OF THE INVENTION

In stadiums, auditoriums and the like, there are typically large areas set with seating arrangements which contain a number of chairs arranged in sections with rows. In some instances, these seating arrangements are floor areas temporarily set with collapsible folding chairs. In assigned seating situations, a ticket or the like identifies a particular assigned seat by letters and/or numbers corresponding to a section, row and/or seat location. In order to locate a particular assigned seat, it is important that these seating arrangements be adequately marked with identifying indicia, such as signs and markers, so people can easily and quickly locate their assigned seats.

In many instances, seating arrangements however tend to be poorly marked for identification. This makes locating one's seat very difficult, and even more difficult with relatively large seating areas in which locating a particular section and row is done from a distance. Experience has further revealed that temporary seating arrangements compound the problems associated with locating a particular assigned seat because of the lack of adequate temporary marking devices for use with temporary seats, such as collapsible folding chairs. As a result, there exists a need for an identifying device that can be employed with temporary seating arrangements, as well as permanent seating arrangements, and that effectively defines seating arrangements for visually locating a particular seat.

An object of the present invention is to provide a device which displays identifying information in manner that effectively defines seating arrangements to aid the user in locating his or her assigned seat relatively quickly.

Another object of the present invention is to provide a device which displays identifying information in a manner that is unobstructive to adjacent seating areas.

An even further object of the present invention is to provide a device which is selectively mountable to a chair frame or the like.

An overall object of the present invention is to provide a device having all the above-mentioned objects which is highly durable, efficient and cost effective to manufacture, install and operate.

Other objects of the invention are discussed below and are shown in the figures.

SUMMARY OF THE INVENTION

In accordance with present invention, there is provided a frame mountable identifying device for visually displaying identifying indicia to aid in locating a particular chair. For releasably mounting the device, the chair may have a bracket with a mounting slot, and the device may having a mounting bracket with a pin for being engagably received in the mounting slot of the bracket of the chair. The device may also include a spacer having a first side attached to the mounting bracket and a second side spaced a predetermined distance from the first side platform. For displaying identifying indicia, the device may include a platform with a rear side mounted to the second side of the spacer and a front side for displaying the identifying indicia. The spacer would then space the rear side of the platform a predetermined distance from the mounting bracket to define a gap between the platform and the mounting bracket.

The mounting bracket may also have an aperture to cooperate with a threaded fastener having a leading end and an abutting end. The fastener may be movable between a mounting position in which the abutting end is spaced from the chair bracket for engaging the pin of the mounting bracket in the slot of the chair bracket and a securing position in which the abutting end abuts the chair bracket to secure the pin in the mounting slot. The leading end may have a tool engaging configuration. The threaded fastener may have sufficient length so that the leading end remains disposed in the gap upon movement between the mounting position and the securing position.

The platform may further include an opening communicating with the gap for providing access to the tool engaging configuration of the leading end of the threaded fastener.

The spacer may also include a holder located in the gap between the mounting bracket and the platform. The holder may slidably receive an elongated support which has an upper end located above the holder and a lower end for being supported adjacent the chair. An elevated platform may be mounted to the upper end of the elongated support for displaying identifying indicia.

The spacer may even further include an interface plate having a bracket mounting side attached to the mounting bracket and a holder mounting side attached to the holder. The mounting bracket and the holder may be attached to the interface plate at a predetermined angle relative to one another for extending the elongated support in a predetermined direction relative to the chair bracket.

The holder may include at least one opening which communicates with the gap and the opening of the platform for providing access to the tool engaging configuration of the leading end of the threaded fastener. The at least one opening of the holder and the opening of the platform may be substantially aligned for providing substantially direct access to the tool engaging configuration of the leading end of the threaded fastener. A tool may be inserted through the openings to engage the leading end of fastener to turn it to move the abutting end between the mounting position and the securing position.

The holder may further include a clamp for releasably clamping the elongated support to prevent the elongated support from moving relative to the holder. The holder may also be a tubular sleeve and the elongated support may also be an elongated pole being slidably received in the tubular sleeve and may be clamped by the clamp to prevent the elongated pole from moving relative to the tubular sleeve. The elongated pole may be clamped intermediate its upper end and lower end.

BRIEF DESCRIPTION OF THE DRAWINGS

The present invention will be described in connection with the accompanying drawings, which illustrate the preferred embodiments and details of the invention, and in which:

FIG. 2A is a front elevational view of a bracket assembly of the frame mountable device of FIG. 1;

FIG. 2B is a cross-sectional view of the bracket assembly taken along line 2B—2B of FIG. 1;

FIG. 2C is a plan view of the bracket assembly of FIG. 2A;

FIG. 3A is a front elevational a display platform of the bracket assembly of FIG. 2A;

FIG. 3B is plan view of the display platform of FIG. 3A;

FIG. 4 is an enlarged elevational view of one end of a fastener of the bracket assembly of FIG. 2B;

FIG. 5A is an enlarged plan view of an insert of the bracket assembly of FIG. 2A;

FIG. 5B is an enlarged side elevational view of the insert of FIG. 5A;

FIG. 6A is an enlarged, exploded elevational view of a holder of the bracket assembly of FIG. 2A;

FIG. 6B is a cross-sectional view of the holder taken along line 6B—6B of FIG. 6A;

FIG. 7A is a front elevational view of an interface plate of the bracket assembly of FIG. 2A;

FIG. 7B is a side elevational view of the interface plate of FIG. 7A;

FIG. 8A is an enlarged front elevational view of a chair bracket of the frame mountable identifying device of FIG. 1;

FIG. 8B is an enlarged front elevational view of a mounting bracket of the bracket assembly of FIG. 2A;

FIG. 9A is an elevational view of an elongated support of the frame mountable identifying device of FIG. 1;

FIG. 9B is a cross-sectional view of the elongated support taken along line 9B—9B of FIG. 9A;

FIG. 10 is an enlarged side elevational view of a display assembly of the frame mountable identifying device of FIG. 1;

FIG. 11A is a front elevational view of an alternative bracket assembly embodying the present invention;

FIG. 11B is a cross-sectional view of the alternative bracket assembly of FIG. 11A; and FIG. 11C is a top view of the alternative bracket assembly of FIG. 11A.

DETAILED DESCRIPTION OF THE PREFERRED EMBODIMENT

Figure 1:
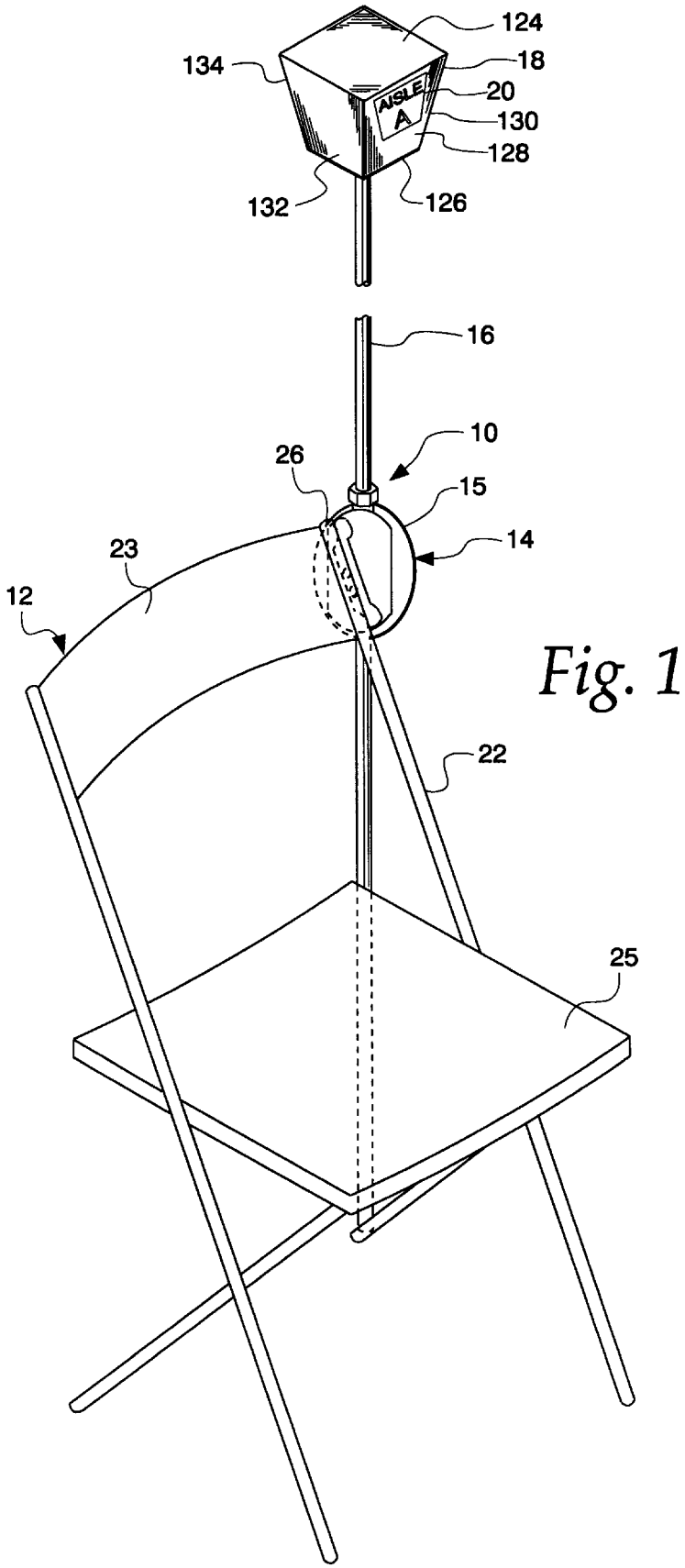
FIG. 1 is a perspective view of a frame mountable identifying device embodying the present invention.

Referring to FIG. 1 of the drawings, there is illustrated one example of the present invention in the form of a frame mountable identifying device 10 attached to a chair 12. The identifying device 10 includes a bracket assembly 14 capable of being attached to the chair 12 for supporting a display platform 15 adapted to display identifying indica 21 (FIG. 3A) outward from the chair 12 and capable of being readily detached from the chair 12 for storage. The device 10 may also include an elongated support 16 having a display assembly 18 which is also adapted to display identifying indicia 20. The bracket assembly 14 is also capable of supporting the elongated support 16 to position the display assembly 18 at a location sufficiently above the chair 12 to limit obstructing the view of others. With the identifying indicia 20 displayed sufficiently above the chair 12, the device 10 provides an effective visual aid for locating a particular seating area from a relative distance. The identifying indicia 20 and 21 may indicate a particular seating section and/or row by a reference number and/or character.

As best illustrated in FIGS. 1, 2A, 2B, and 2C, the bracket assembly 14 is adapted to mount the identifying device 10 to a frame member 22 of the chair 12. The frame member 22 angles upward and backward from a seat 25 of the chair 12 for supporting a back rest 23. To allow the device 10 to be easily attached and detached from the chair 12, the bracket assembly 14 includes a mounting bracket 24 (FIG. 8A) that cooperates with a chair bracket 26 (FIG. 8B). The chair bracket 26 is aligned with and affixed to the frame member 22 at a location adjacent the back rest 23.

In addition to the mounting bracket 24, the bracket assembly 14 includes generally an interface plate 28 attached to the mounting bracket 24, a holder 30 attached to the interface plate 28 and the display platform 15 which is attached to the holder 30. These components of the bracket assembly 14 among others are discussed below.

As best illustrated in FIGS. 8A and 8B, the mounting bracket 24 cooperates with the chair bracket 26 to selectively attach and detach the device 10 from the frame member 22 (FIG. 1) of the chair 12. More specifically, the chair bracket 26 includes a substantially rectangular base portion 34 and a pair of identical tabs 36 to attach the chair bracket 26 to the frame member 22. One of the tabs 36 extends from each end 38 of the base portion 34, and each tab 36 is adapted to extend from the base portion 34 into a plane substantially parallel to that containing the base portion 34 so that when the chair bracket is attached to the frame member 22 the base portion 34 is spaced a predetermined distance from the frame member 22 to bridge over the frame member 22 to form a gap between the frame member 22 and the base portion 34.

The chair bracket 26 may have a length of about 5½ inches (in.) with the base portion having a length of about 3 in. and a width of about 1⅛ in. and each tab having a length of about 1³⁄₁₆ in. and a width of about ¹⁹⁄₃₂ in. The chair bracket 26 may be made from a steel plate and may be welded to the frame member 22 of the chair 12. Alternatively, the chair bracket may be made of plastic.

The mounting bracket 24 includes a rectangular base portion 40 and a pair of identical tabs 42 in which one of the tabs 42 extends from each of the ends 44 of the base portion 40 into a plane substantially parallel to the base portion 40. When the tabs 42 are attached to the interface plate 28, the base portion 40 is spaced a predetermined distance from the interface plate 28 to bridge above the interface plate 28 to form a gap 45 (FIG. 2B) between the base portion 40 and the interface plate 28. The mounting bracket 24 may also have the same dimensions as those above-described for the chair bracket 26. The mounting bracket 24 may be made from a steel plate and may be welded to the interface plate 28. Alternatively, the mounting bracket 24 may be made of plastic.

As best illustrated in FIGS. 2A, 2B, 2C, 8A and 8B, the mounting bracket 24 includes a stud 46, with an enlarged head 48, projecting from the base portion 40 for interengaging a key slot 50 defined by the base portion 34 of the chair bracket 26 to attach the bracket assembly 14 to the chair frame 22. More specifically, the key slot 50 is an elongated rectangular slot that is longitudinally divided into a first portion 52 and a narrower second portion 54. The first portion 52 is wide enough to allow the head 48 of the stud 46 to pass through the key slot 50 into the gap formed between the base portion 34 of the chair bracket 26 and the chair frame member 22. The second portion 54 is narrower than the first portion 52 for prohibiting the head 48 of the stud 46 from passing through the key slot 50. For instance, the key slot may be in the range of about 1 to 2 in. long and the stud may be located in the range of about ½ to 1 in. from one of the end edges of the base portion of the mounting bracket.

To interengage the mounting bracket 24 with the chair bracket 26, the brackets 24 and 26 are brought together to extend the head 48 of the stud 46 through the first portion 52 of the key slot 50 and into the gap between the chair bracket 26 and the chair frame member 22. The mounting bracket 24 is then slid downward relative to the chair bracket 26 to move the stud 46 to extend through the second portion 54 of the key slot 50. When the stud 46 is extended through the second portion 54 of the key slot 50, the head 48 of the stud 46 extends beyond the second portion 54 of the key slot 50 to engage the base portion 34 so that the chair bracket 26 is positioned between the head 48 of the stud 46 and the base portion 40 of the mounting bracket 24. This restricts release of the mounting bracket 24, from the chair bracket 24. Additionally, the stud 46 should have a predetermined length that is slightly greater than the thickness of the base portion 34 of the chair bracket 26 so that the mounting bracket 24 and the chair bracket 26 are in close proximity to one another when the stud 46 is interengaged with the key slot 50. To detach the mounting bracket 24 from the chair bracket 26, the above-described procedure is reversed.

As best illustrated in FIGS. 2A, 2B, 2C, 7A and 7B, the mounting bracket 24 is attached to the interface plate 28. More specifically, the interface plate 28 has a substantially planar and rectangular shape defined by arcuate end edges 56 and linear side edges 58 and has a front side 60 and a rear side 62. The mounting bracket 24 is affixed to the front side 60 to extend diagonally from left to right going from top to bottom of the interface plate 28, as best viewed in FIG. 2A. The interface plate 28 may be made from a sheet of steel or the like, and the tabs 42 of the mounting bracket 24 may be welded to the front side 60 of the interface plate 28. The interface plate may have a width of about 4 in. and a maximum length of about $5\frac{11}{32}$ in., and the arcuate edges may have a radius of curvature of about $2\frac{43}{64}$ in. Alternatively, the interface plate 28 may be made of plastic.

As best illustrated in FIGS. 2A, 2B, 2C, 6A and 6B, the holder 30 is attached to the rear side 62 of the interface plate 28 and is adapted to be capable of supporting the elongated tube 16. More specifically, the holder 30 is an elongated sleeve with a circular cross-section, as best viewed in FIG. 6B. The holder 30 includes an inner surface 63, an outer surface 64 and a top and bottom end 66 and 68, respectively. The outer surface 64 of the holder 30 is attached to the rear side 62 of the interface plate 28 so that the holder extends centrally and vertically between the end edges 56 of the interface plate 28. The mounting bracket 24 and the holder 30 are disposed at a predetermined angle relative to one another to compensate for the angled chair frame member 22 to ensure that the elongated support 16 is supported substantially vertical by the bracket assembly 14. The predetermined angle is dependent upon the angle of the chair frame member 22. For instance, if the chair frame member 22 extends upward at an angle of 45 degrees relative to the ground, the predetermined angle is approximately 45 degrees. The holder may be made from metal conduit pipe and may have a length of about 6 in. and a diameter of about ¾ in. Alternatively, the holder may be made of plastic.

As best illustrated in FIGS. 2A, 2B, 2C, 3A and 3B, the display platform 15 is attached to the holder 30 and displays identifying indica 21 in direction outward from the chair 12 (FIG. 1). More specifically, the display platform 15 has a substantially planar and circular shape defined by an outer circular edge 70. The display platform 15 includes a front side 72 and rear side 74. The rear side 74 is affixed to the outer surface 64 of the holder 30 at a location diametrically opposed to where the interface plate 28 is attached to the holder 30. The rear side 74 may be provided with a pair of identical rectangular rails 76 that are affixed to the rear side 74 to run vertically and symmetrically about the center of the display platform 15. The holder 30 is then affixed to the rails 76 which are spaced a predetermined distance apart so that the holder 30 is spaced slightly from the rear side 74 of the display platform 15. However, the holder 30 may engage the rear side 74 of the platform 15 between the rails 76. The display platform 15 may be made from steel and may be welded directly to the rear side 74 of the display platform 15 or may be welded to the rails 76, which also may be made from steel. The identifying indica 21 is affixed to the front side 72 of the display platform. The display platform may have a diameter of about 6 in. Alternatively, the display platform may be made of plastic.

As best illustrated in FIGS. 2A, 2B, 5A and 5B, the bracket assembly 14 may also be selectively locked to the chair frame member 22 to prevent unintentional release. More specifically, the bracket assembly 14 may include a screw 78, or bolt, that includes an enlarged end 80 for abutting the chair bracket 26 and a tool configured end 82, located opposite the abutting end 80, that is adapted to be turned by a tool (not shown). The screw 78 is moveable between a mounting position in which the enlarged end 80 is spaced from the chair bracket 26 to allow the stud 46 of the mounting bracket 24 to be inserted and interengaged with the key slot 50 of the chair bracket 26 and a securing position in which the enlarged end 80 engages the chair bracket 26 over the key slot 50 to clamp the chair bracket 26 between the abutting end 80 of the screw 78 and the enlarged head 48 of the stud 46 to prohibit movement of the bracket assembly 14 relative to the chair frame member 22. The screw may be a ⅜–16×⅝ in. set screw having a length of about ⅝ in. The screw may be made of steel or plastic.

For cooperating with the screw 78, the bracket assembly 14 includes an insert 84 having a rectangular planar shape and includes a front and back side 86 and 88, respectively. The insert 84 defines an aperture 90 and includes a sleeve 92 having a threaded interior surface 94 form fitted into the aperture 90. The sleeve 92 projects from front side 86. The base portion 40 of the mounting bracket 24 defines an aperture 96, as best illustrated in FIG. 6A, and includes a back side 98, as illustrated in FIG. 2B. The insert 84 is affixed to the back side 98 of the base portion 40 of the mounting bracket 24 and the projection portion of the sleeve 92 is form fitted through the aperture 96 of the base portion 40 of the mounting bracket 24. The insert 84 and sleeve 92 may be made from steel, and the insert 84 may be welded to the back side 98 of the base portion 40 of the mounting bracket 24. The sleeve may be sized to operatively accommodate the above-described set screw. Alternatively, the insert and sleeve may be made of plastic.

To provide access to the tool configured end 82 of the screw 78, the interface plate 28 defines a centrally located aperture 100, the holder 30 defines a pair of aligned apertures 102 and the display platform 15 defines a centrally located aperture 104, as best illustrated in FIGS. 2B, 6A, 6B, and 3A. The apertures 100, 102 and 104 are aligned to allow unobstructed access to the tool configured end 82 of the screw 78. The tool then may be inserted into the bracket assembly 14 from the display platform 15 to engage the tool configured end 82 to turn the screw 78 to move the engaging end 82 between the mounting position and the securing position. The above-described apertures defined by the interface plate, the tool holder and the holder may all have a diameter of about ½ in.

As best illustrated in FIG. 4, the tool configured end 82 may include an interior surface 108 defining a centrally located bore 106 with a particular shape adapted to grip a complementarily adapted end of a tool (not shown). For instance, the interior surface 108 may define a octagonal or hexagonal bore adapted to grip a tool end having the same profiled shape. However, the surface 108 may define any bore shape as long as it grips the particular tool end.

As best illustrated in FIG. 2B, the screw 78 may have sufficient length so that the tool configured end 82 remains disposed in the gap 45 between the base portion 40 of the mounting bracket 24 and the interface plate 28 during movement of the abutting end 80 between the mounting position and the securing position. As a result, the screw 78 does not interfere with the holder 30. Further, the above-described arrangement prohibits unauthorized access to the screw 78 without a tool and limits the ability of one without the required tool to detach the bracket assembly 14 from the chair 12.

As best illustrated in FIGS. 1, 9A and 9B, the bracket assembly 14 is capable of supporting the elongated support 16 to position the display assembly 18 above the chair 12. As illustrated, the elongated support 16 may be an elongated tube or pole having an upper end 110 and a lower end 112. The display assembly 18 is mounted to the upper end 110.

The elongated pole 16 has a circular cross-section having a diameter less than that of the holder 30 so that the pole 16 may be extended through the holder 30 to be supported by the holder 30. The lower end 112 of the pole 16 may rest on the ground adjacent the chair, or alternatively, a shortened pole that does not extend to the ground may be used because the holder may be sufficiently long to prevent the pole from tipping out of the holder 30. The pole may be made from ½ in. metal conduit pipe and may have a length in the range of about 6 to 8 feet. Alternatively, the pole may be made of plastic.

As best illustrated in FIGS. 6A, 6B, 9A and 9B, the holder 30 is adapted to maintain and selectively clamp the pole 16 against movement relative to the bracket assembly 14. More specifically, the top end 66 of the holder 30 may include a conduit connector 119 having a collar 114 with threads 116 to cooperate with a lock nut 118 and a split sleeve 120 to clamp the pole 16. When the lock nut 118 is tightened, the split sleeve 120 grips an outer surface 122 of the pole 16. This locks the pole 16 in the holder 30. The lock nut 118 is also easily loosened to remove the pole 16 for storage. The conduit connector may be a ½ in. conduit connector. The conduit connector 119 enables the pole 16 to be removed for storage at any time, such as after the spectators have located their seats, to further prevent visual obstruction of the event by the device 10.

As best illustrated in FIGS. 1, 9A and 10, the display assembly 18 is mounted to the upper end 110 of the pole 16 and may be of any form that is capable of displaying identifying indica. As illustrated, the display assembly 18 is in the form of a box having a top wall 124, bottom wall 126 and four identical side walls 128, 130, 132 and 134. The side walls 128, 130, 132 and 134, as illustrated, taper inward from the top wall 124 down to the bottom wall 126. The top wall may have an approximate size of 5 in.×5 in.; the bottom wall may have an approximate size of 3 3/16 in.×3 3/16 in.; and the side walls may have an approximate size of 4 7/8 in.×4 7/8 in. The identifying indicia 20 may be affixed to the side walls 128, 130, 132 and 134. The display assembly may be made of metal or plastic.

The pole 16 is attached to the display assembly 18 in any manner that securely affixes the display assembly 18 to the upper end 110 of the pole 16. For instance, the upper end 110 of the pole 16 may be welded to the bottom wall 126 of the display assembly 18, or the upper end 110 of the pole 16 may extend through an opening (not shown) in the bottom wall 126 so that the bottom wall 126 is welded to the pole 16 at a location adjacent its upper end 110. Alternatively, the bottom wall 126 may be formed to include a conduit connector (not shown) similar to the conduit connector 119 of the holder 30, as illustrated in FIG. 6A. The conduit connector clamps the upper end 110 of the pole 16 to attach the display assembly 18 to the pole 16. The conduit connector may alternatively be a part of the top wall 124 of the display assembly 18 where the pole 16 would extend through an opening (not shown) in the bottom wall 126 to extend through the display assembly 18 to the top wall 124 to be clamped by the conduit connector.

The side walls 128, 130, 132 and 134 of the display assembly 18 or the identifying indica 20 itself may be transparent so that a light source located in the display assembly 18 may outline or illuminate the identifying indica 20 itself, depending on which is transparent.

The dimensions above-indicated for the identifying device may be made smaller or larger depending on the desired size for the identifying device.

As best illustrated in FIGS. 11A, 11B and 11C, an alternative bracket assembly 140 may be for use without the elongated support 16 and the holder 30 of the above-described identifying device 10. More specifically, a mounting bracket 142 may be affixed, such as by welding, directly to a display platform 144. The structure of the mounting bracket 142 and display platform 144 is otherwise identical to the above-described bracket assembly 14 and display platform 15. The mounting bracket 142 functions to mount the bracket assembly 140 identical to that above-described for the mounting bracket 24. The alternative bracket assembly 140 displays row or chair identifying information attached to the display platform 144.

It will be understood that various changes in the details, materials and arrangement of parts and systems which have been herein described and illustrated in order to explain the nature of the present invention may be made by those skilled in the art within the principle and scope of the present invention as expressed in the appended claims.

What is claimed is:

1. An apparatus for mounting to a chair for displaying identifying indicia, the apparatus comprising:

a chair bracket capable of being affixed to the chair and having a mounting slot;

a mounting bracket having a pin for being engagably received in the mounting slot of the chair bracket for releasably mounting the apparatus to the chair, the mounting bracket having a threaded aperture;

a spacer having a first side attached to the mounting bracket and having a second side spaced a predetermined distance from the first side;

a platform having rear side mounted to the second side of the spacer and having a front side for displaying identifying indica, the spacer spacing the rear side of the platform a predetermined distance from the mounting bracket to define a gap between the platform and the mounting bracket; and a threaded fastener engaged in the threaded aperture, the threaded fastener having a leading end and an abutting end, the fastener being movable between a mounting position in which the abutting end is spaced from the chair bracket for engaging the pin of the mounting bracket in the slot of the chair bracket and a securing position in which the abutting end abuts the chair bracket to secure the pin in the mounting slot.

2. An apparatus in accordance with claim 1 wherein the threaded fastener has sufficient length that the leading end remains disposed in the gap upon movement between the mounting position and the securing position.

3. An apparatus in accordance with claim 2 wherein the leading end of the threaded fastener includes a tool engaging configuration for being capable of being turned by a tool to move the fastener between the mounting position and the securing position.

4. An apparatus in accordance with claim 3 wherein the platform further defines an opening communicating with the gap for providing access to the tool engaging configuration of the leading end of the threaded fastener.

5. An apparatus in accordance with claim 1 wherein the spacer further comprises a holder located in the gap between the mounting bracket and the platform.

6. An apparatus in accordance with claim 5 further comprising:

an elongated support being slidably received in the holder and having an upper end located above the holder and a lower end for being supported adjacent the chair; and an elevated platform mounted to the upper end of the elongated support for displaying identifying indicia.

7. An apparatus in accordance with claim 6 wherein the spacer further comprises an interface plate having a bracket mounting side attached to the mounting bracket and a holder mounting side attached to the holder.

8. An apparatus in accordance with claim 7 wherein the mounting bracket and the holder are attached to the interface plate at a predetermined angle relative to one another for extending the elongated support in a predetermined direction relative to the chair bracket.

9. An apparatus in accordance with claim 8 wherein the holder defines at least one holder opening and the platform defines a platform opening, the at least one holder opening and the platform opening providing access to the tool engaging configuration of the leading end of the threaded fastener.

10. An apparatus in accordance with claim 9 wherein the at least one holder opening and the platform opening are substantially aligned for providing substantially direct access to the tool engaging configuration of the leading end of the threaded fastener.

11. An apparatus in accordance with claim 6 wherein the holder further comprises a clamp for releasably clamping the elongated support to prevent the elongated support from moving relative to the holder.

12. An apparatus in accordance with claim 11 wherein the holder is a tubular sleeve and the elongated support is an elongated pole being slidably received in the tubular sleeve and being clamped by the clamp to prevent the elongated pole from moving relative to the tubular sleeve.

13. An apparatus in accordance with claim 12 wherein the elongated pole is clamped intermediate the upper end and lower end of the pole.

14. An apparatus for mounting to a chair for displaying identifying indicia, the apparatus comprising:

a chair bracket capably of being affixed to the chair and having a mounting slot;

a mounting bracket having a base with a pin for being engagably received in the mounting slot of the chair bracket for releasably mounting the apparatus to the chair, the mounting bracket having a threaded aperture;

a platform having a rear side and having a front side for displaying identifying indicia;

a connector extending between the platform and the base of the mounting bracket and being configured to space the rear side of the platform a predetermined distance from the threaded aperture of the mounting bracket to define a gap between the platform and the threaded aperture of the mounting bracket; and a threaded fastener engaged in the threaded aperture, the threaded fastener having a leading end and an abutting end, the fastener being movable between a mounting position in which the abutting end is spaced from the chair bracket for engaging the pin of the mounting bracket in the slot of the chair bracket and a securing position in which the abutting end abuts the chair bracket to secure the pin in the mounting slot.

15. An apparatus in accordance with 14 wherein the threaded fastener has sufficient length that the leading end remains disposed in the gap upon movement between the mounting position and the securing position.

16. An apparatus in accordance with claim 15 wherein the leading end of the threaded fastener includes a tool engaging configuration for being capable of being turned by a tool to move the fastener between the mounting position and the securing position.

17. An apparatus in accordance with claim 14 wherein the connector further comprises at least one tab directly interconnecting the base of the mounting bracket to the platform.

18. An apparatus in accordance with claim 17 wherein the at least one tab is integral with the base of the mounting bracket and affixed directly to the rear side of the platform.

19. An apparatus in accordance with claim 18 wherein a weld affixes at least one tab of the connector directly to the rear side of the platform.

20. An apparatus in accordance with claim 1 wherein the rear side of the platform is mounted to the spacer, the spacer spacing the rear side of the platform a second predetermined distance from the threaded aperture of the mounting bracket to define a second gap between the platform and the threaded aperture of the mounting bracket.

21. An apparatus in accordance with claim 20 wherein the connector further comprises at least one tab directly attached to the spacer.

22. An apparatus in accordance with claim 21 wherein the at least one tab is integral with the base of the mounting bracket and affixed directly to the spacer.

* * * * *